US010258523B2

(12) United States Patent
Laszczyk

(10) Patent No.: US 10,258,523 B2
(45) Date of Patent: Apr. 16, 2019

(54) PATIENT TURNING APPARATUS AND METHODS FOR USE

(71) Applicant: Judith Lynn Laszczyk, Gibbstown, NJ (US)

(72) Inventor: Judith Lynn Laszczyk, Gibbstown, NJ (US)

( * ) Notice: Subject to any disclaimer, the term of this patent is extended or adjusted under 35 U.S.C. 154(b) by 254 days.

(21) Appl. No.: 15/313,261

(22) PCT Filed: May 12, 2015

(86) PCT No.: PCT/US2015/030347

§ 371 (c)(1),
(2) Date: Nov. 22, 2016

(87) PCT Pub. No.: WO2015/183543

PCT Pub. Date: Dec. 3, 2015

(65) Prior Publication Data

US 2017/0181907 A1 Jun. 29, 2017

Related U.S. Application Data

(63) Continuation of application No. 14/287,296, filed on May 27, 2014, now abandoned.

(51) Int. Cl.
*A61G 7/00* (2006.01)
*A61G 7/10* (2006.01)

(52) U.S. Cl.
CPC ..... *A61G 7/001* (2013.01); *A61G 7/10* (2013.01); *A61G 7/1023* (2013.01); *A61G 7/1051* (2013.01); *A61G 2200/32* (2013.01)

(58) Field of Classification Search
CPC ..... A61G 7/001; A61G 7/10; A61G 7/1023; A61G 7/1051
See application file for complete search history.

(56) References Cited

U.S. PATENT DOCUMENTS

| | | | | |
|---|---|---|---|---|
| 1,711,167 | A | 4/1929 | Blake | |
| 4,180,879 | A | 1/1980 | Mann | 5/508 |
| 4,536,903 | A | 8/1985 | Parker | 5/61 |
| 4,655,207 | A | 4/1987 | Ellis | 128/135 |
| 5,274,862 | A | 1/1994 | Palmer | 5/81.1 |
| 8,161,583 | B1 | 4/2012 | Palen | 5/81.1 |
| 2002/0029417 | A1 | 3/2002 | Walker | 5/81.1 |
| 2005/0055769 | A1 | 3/2005 | Taylor | 5/81.1 |
| 2006/0185078 | A1 | 8/2006 | Perry | 5/81.1 |
| 2009/0183309 | A1 | 7/2009 | Stinson | 5/81.1 |

OTHER PUBLICATIONS

International Search Report and Written Opinion in PCT/US15/030347 dated Aug. 5, 2015.
International Preliminary Report on Patentability in PCT/US15/030347 dated Apr. 25, 2016.
Office Communication dated Dec. 3, 2015 in U.S. Appl. No. 14/287,296 dated Dec. 3, 2015.
Office Communication dated Feb. 2, 2016 in U.S. Appl. No. 14/287,296 dated Dec. 3, 2015.

*Primary Examiner* — Kristen Matter
(74) *Attorney, Agent, or Firm* — Licata & Tyrrell P.C.

(57) ABSTRACT

Apparatus and methods for turning a patient onto their side without having to place anything under the patient's torso in order to turn the patient are provided. This disclosure provides apparatus and methods for turning a patient with these apparatus without having to place anything under the patient's torso. Certain embodiments provide apparatus specifically designed to enable a caregiver to turn a patient without the assistance of a second person to hold them in place.

13 Claims, 9 Drawing Sheets

PATIENT TURNING APPARATUS AND METHODS FOR USE

This patent application is the National Stage of International Application No. PCT/US2015/030347 filed May 12, 2015, which claims the benefit of priority from U.S. application Ser. No. 14/287,296, filed May 27, 2014 each of which are herein incorporated by reference in their entirety.

BACKGROUND

For many patients who are immobile and/or bed bound, caregivers frequently need to turn these patients onto their side in order to complete patient care tasks, such as cleaning the patient's buttocks and changing the linens under the patient. Many patients are unable to move or assist the caregiver with completing these tasks.

U.S. Pat. No. 4,675,925 discloses a device for manipulating bedridden patients which comprises a flexible plain sheet sized to underlie the torso of a patient with releasable fastening means of elongated tie-straps secured on each side of the sheet which fix the sheet to the lower bed rails. To turn the patient, the fastening means are released on one side of the bed and then refastened to the top rails on the other side of the bed.

U.S. Pat. No. 6,073,279 discloses a strap for assisting in rotation of a patient in a convalescing bed comprising an elongated rectangle of textured material with a series of VELCRO hooks and loops on each end of the rectangle which attach the strap to the opposite bottom rungs of the bedrails. To turn the patient using this device, the patient is arranged on his backside over the strap. One side of the strap is then released and lifted over the patient toward the opposite bedrail while applying pressure to the backside of the patient thereby rotating the patient onto their other side. This end of the strap can then be fixed to the top portion of the bed rail to support the patient.

Published U.S. Patent Application No. 2007/0235042 discloses a strap/belt with an adjustable padded center support for turning a patient which fixes to the bedrails via metal grommets at each end of the strap. The strap is placed under the patient near their waist. A very similar device is disclosed in U.S. Pat. No. 3,884,225.

Currently, caregivers such as nurses or nurse's aides use a "draw sheet" (a bed sheet folded in half) or their hands which must be placed under the patient's torso and pulled by the caregiver in order to turn the patient onto their side. A second person is usually required to assist the caregiver with this method in order to turn and hold the patient on their side while the first caregiver completes the cleaning/changing of linens.

Unfortunately, for caregivers, this method results in many injuries from poor body mechanics and muscle strain from repetitively lifting and pulling for prolonged periods of time.

There is a need for apparatus which allow caregivers to more easily turn patients in need.

SUMMARY OF DISCLOSURE

This disclosure provides apparatus and methods for turning a patient with these apparatus without having to place anything under the patient's torso.

Certain embodiments provide apparatus specifically designed to enable a caregiver to turn a patient without the assistance of a second person to hold them in place.

Certain embodiments provide apparatus and methods for placing the apparatus under the neck and knees of the patient, securing the apparatus, turning the patient onto their side, and securing the apparatus to a stabilizing means on or adjacent to the bed in order to hold the patient on their side while the caregiver is able to complete all necessary patient care with minimal strain.

Accordingly, an aspect of the present disclosure relates to an apparatus for turning patients which enables the caregiver to turn a patient lying in bed without having to place the turning apparatus under the patient's torso in order to turn the patient.

The apparatus comprises a sling having an inside and outside and a top, bottom and center comprised of durable, flexible material shaped and sized to cradle a side of the patient's torso. In one nonlimiting embodiment, the sling is U-shaped.

In one nonlimiting embodiment, the apparatus further comprises a first extension or side strap with a first and second end. The first extension or strap is attached at the first end to the top outside of the sling for placement under a patient's neck. A fastening means is placed at the second end of the first extension or strap for securing the apparatus to a stabilizing means on or adjacent to the bed. In this nonlimiting embodiment, the apparatus further comprises a second extension or side strap with a first and second end attached by the first end to the outside bottom of the sling for placement under the patient's knees. A fastening means is placed at the second end of the second extension or strap for securing the apparatus to a stabilizing means on or adjacent to the bed.

In another nonlimiting embodiment, the sling further comprises a fastening means for joining the top of the sling to the bottom of the sling after placement under the patient's neck and knees. In this embodiment, the patient's body weight secures the apparatus in place during turning.

The apparatus further comprises one or more handles and one or more straps attached to the outside of the sling for pulling the sling and patient toward the secured apparatus, thereby turning the patient.

In one nonlimiting embodiment, the apparatus further comprises a center handle and central strap with a first and second end attached by the first end to the outside of the sling or handle. The central strap further comprises a fastening means at the second end for securing to the stabilizing means so that the turned patient is held in place.

In an alternative nonlimiting embodiment, two or more handles and two or more central straps with fastening means are attached to the outside of the sling near the center to more evenly distribute a patient's weight during turning. In this nonlimiting embodiment, each central strap may be attached separately to the stabilizing means or the central straps may be gathered together to form a single strap which is then attached to the stabilizing means.

Another aspect of this disclosure relates to methods for turning a patient with these apparatus.

BRIEF DESCRIPTION OF THE DRAWINGS

As shown in FIG. 2A, the caregiver places the first side strap under the patient's neck and the second side strap under the patient's knees and attaches the side straps to the bed rail via the VELCRO fastening means.

FIG. 2B illustrates turning of the patient onto their side by the caregiver pulling the center handle and attaching the central strap to the bed rail.

FIG. 2C illustrates the caregiver turning the patient to their opposite side by releasing the central strap and pulling the two side straps toward the opposite side of the bed and attaching the two side straps to the opposite bed rail.

As shown in FIG. 4A, the caregiver places the top of the sling under the patient's neck and the bottom of the sling under the patient's knees and attaches the bottom of the sling to the top of the sling. FIG. 4B illustrates turning of the patient onto their side by the caregiver pulling the center handle and attaching the central strap to the bed rail. In this embodiment, the sling is secured in place by the patient's body weight.

DETAILED DESCRIPTION

This disclosure provides apparatus and methods for turning a patient without having to place anything under the patient's torso. Instead, portions of the apparatus are placed under the neck and knees of the patient. The apparatus is then secured to either to a stabilizing means on or adjacent to a bed or stretcher or via a patient's weight as they are turned onto their side. As the patient is turned onto their side, the apparatus forms a cradle or sling around the patient. Once the patient is turned, the apparatus is secured to a stabilizing means in order to hold the patient on their side while the caregiver is able to complete all necessary patient care with minimal strain and without the assistance of a second person to hold them in place. The apparatus is also useful in preventing bedsores in a patient as they can remain comfortably elevated on their side for a period of time, thus alleviating pressure on their back and backside. In addition, the apparatus can be used by an otherwise mobile person who must sleep on one side or the other for medical reasons.

In simplest form, the apparatus comprises a flexible durable material, preferably U-shaped, sized to cradle the side of a patient's torso between the hips and shoulders, one or more straps with fastening means to fix the apparatus in place and one or more handles for the caregiver to use to turn the patient via the apparatus. Various nonlimiting embodiments of the apparatus of this disclosure are depicted in FIG. 1A through FIG. 6.

Figure 6:
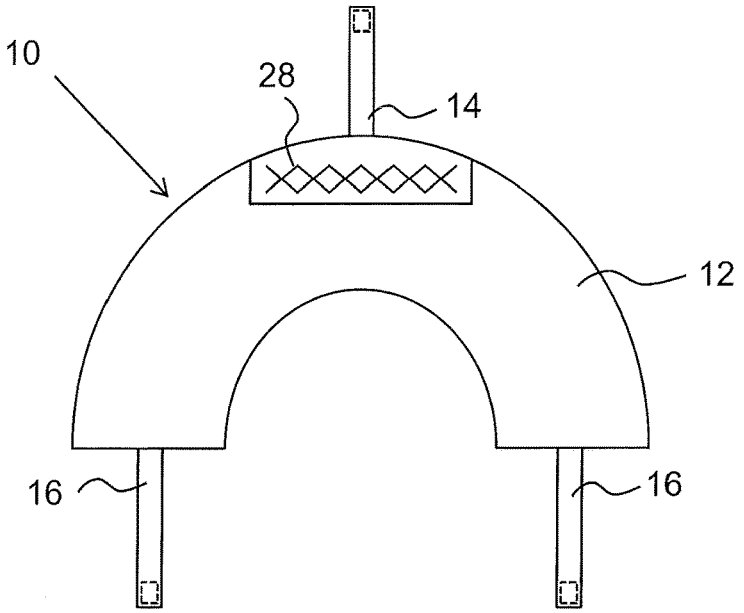
FIG. 6 shows an inside view of a nonlimiting embodiment wherein the sling further comprises a reinforced area.

In one nonlimiting embodiment, as depicted in FIG. 1A through 2C, the apparatus comprises a U-shaped durable flexible material, referred to herein as a sling 12, which is sized to cradle the side of a patient's torso between the hips and shoulders. Examples of durable, flexible materials which can be used to form the sling include, but are not limited to nylon, rayon, linen, cotton, wool, polyester, polyethylene, polypropylene, flannel, fleece, silk, rip stop nylon, plastic, vinyl, polyurethane, and any other fibers or blends of the aforementioned fabrics or materials. The sling 12 has an outside (FIG. 1A) to which one or more straps and handles are attached and an inside (FIG. 1B) which is placed adjacent to the patient, as well as a top, bottom and center portion. In one embodiment, as depicted in FIG. 6, a reinforced area 28 is placed on the inside of the sling. In one nonlimiting embodiment, the reinforced area comprises an additional layer or layers of sling material. In another embodiment, the reinforced area comprises a layer or layer of material different from the sling material which adds strength to the sling material.

As shown in the nonlimiting embodiment of FIG. 1A through 2C, the apparatus further comprises first and second side straps or extensions 16, each having a first and second end. The first extension or strap 16 is attached at the first end to the top outside of the sling for placement under a patient's neck (see FIGS. 2A and 2B). The second extension or side strap 16 is attached by the first end to the outside bottom of the sling for placement under the patient's knees.

In this nonlimiting embodiment, the apparatus further comprises a center handle 18 and a central strap 14 with a first and second end attached by the first end to the outside center of the sling or handle. The central strap further comprises a fastening means at the second end for securing to a stabilizing means so that the turned patient is held in place.

Examples of stabilizing means to which the strap can be fastened include, but are not limited to a bed or stretcher side rail, a bed or stretcher frame, or a ceiling, mobile or floor lift. In addition, as will be understood by the skilled artisan upon reading this disclosure, for home use, a regular bed can be modified with any stabilizing means for fastening of the straps to the bed or bed frames. Examples of such modification means include, but are in no way limited to, VELCRO loops affixed to the bed frame, metal brackets, loops, circles, bars or hooks affixed to the bed frame, and metals screws or clamps affixed to the bottom of the bed to which the strap or straps of the apparatus can be fixed.

The term "bed" as used herein is meant to be inclusive, of all types of beds, hospital beds and surgical beds as well as stretchers, air mattresses, and any other piece of furniture upon which a person may sleep or rest.

Figure 5:
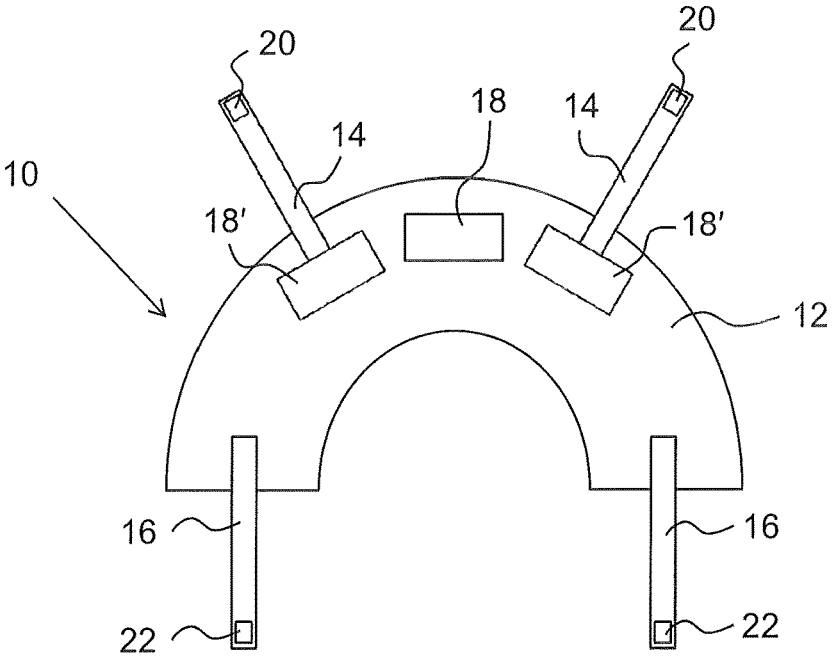
FIG. 5 shows an outside view of an alternative nonlimiting embodiment of the apparatus with multiple handles and two straps positioned near the center to more evenly distribute a patient's weight.

In an alternative nonlimiting embodiment as shown in FIG. 5, two or more handles 18, 18' and two or more central straps 14 with fastening means are attached to the outside of the sling near the center to more evenly distribute a patient's weight during turning. In this nonlimiting embodiment, each central strap may be attached separately to the stabilizing means or the central straps may be gathered together to form a single strap which is then attached to the stabilizing means.

Side straps 16, central straps 14 and handles 18, 18' can be attached to the sling by any suitable means. Examples of suitable attachment means include, but are not limited to, stitching, glue, VELCRO, snaps, pins, buckles, quick release buckles, zippers, buttons, locks, clasps, knots, ties, loops, latches, ropes, string, cord, noose, clamps, hooks, belts or wire.

Side straps, central straps and handles can be comprised of various materials including, but not limited to nylon, VELCRO and polypropylene webbing materials.

Fastening means 22 and 20 are placed at the second end of each of the side straps 16 and central straps 14 for securing the apparatus to the stabilizing means. Preferred is that the fastening means provide for adjustment of the length of the strap. Examples of such fastening means for the side straps and central straps include, but are not limited to, VELCRO, adjustable buckles, quick release adjustable buckles, snaps, clamps, hooks, clasps, buttons, etc.

Figure 1A:
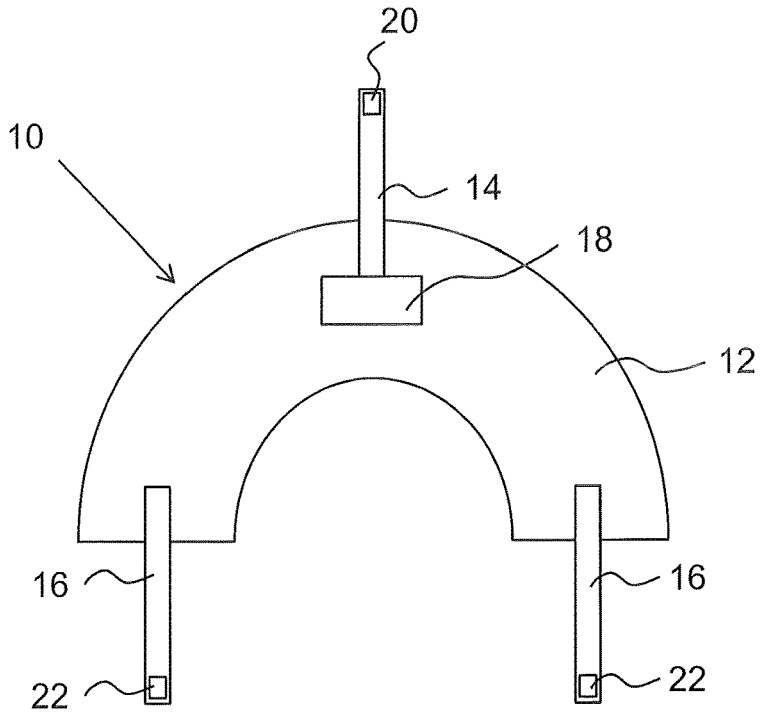
FIGS. 1A and 1B are diagrams illustrating an outside view (FIG. 1A) and inside view (FIG. 1B) of one nonlimiting embodiment of a U-shaped turning apparatus of this disclosure. In this nonlimiting embodiment, the apparatus has a center handle and central strap, first and second side straps and VELCRO fastening means.
Figure 1B:
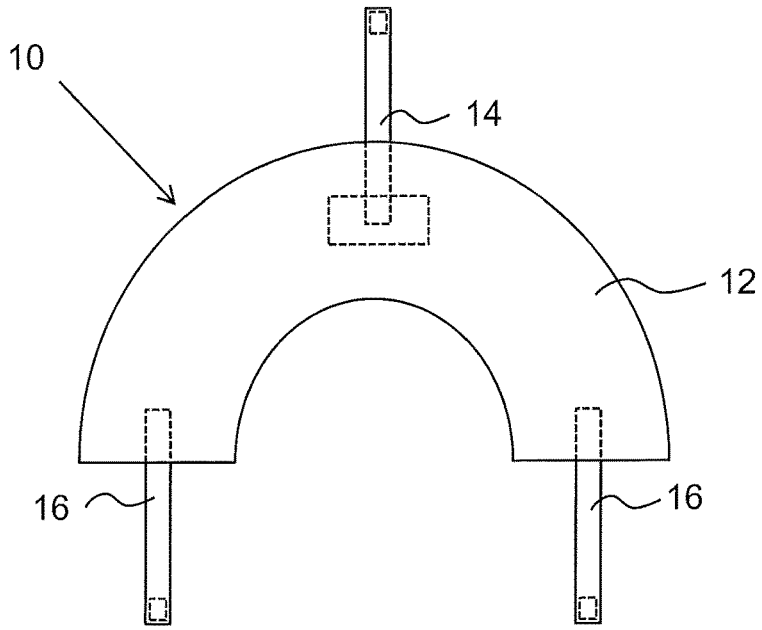
Figure 2A:
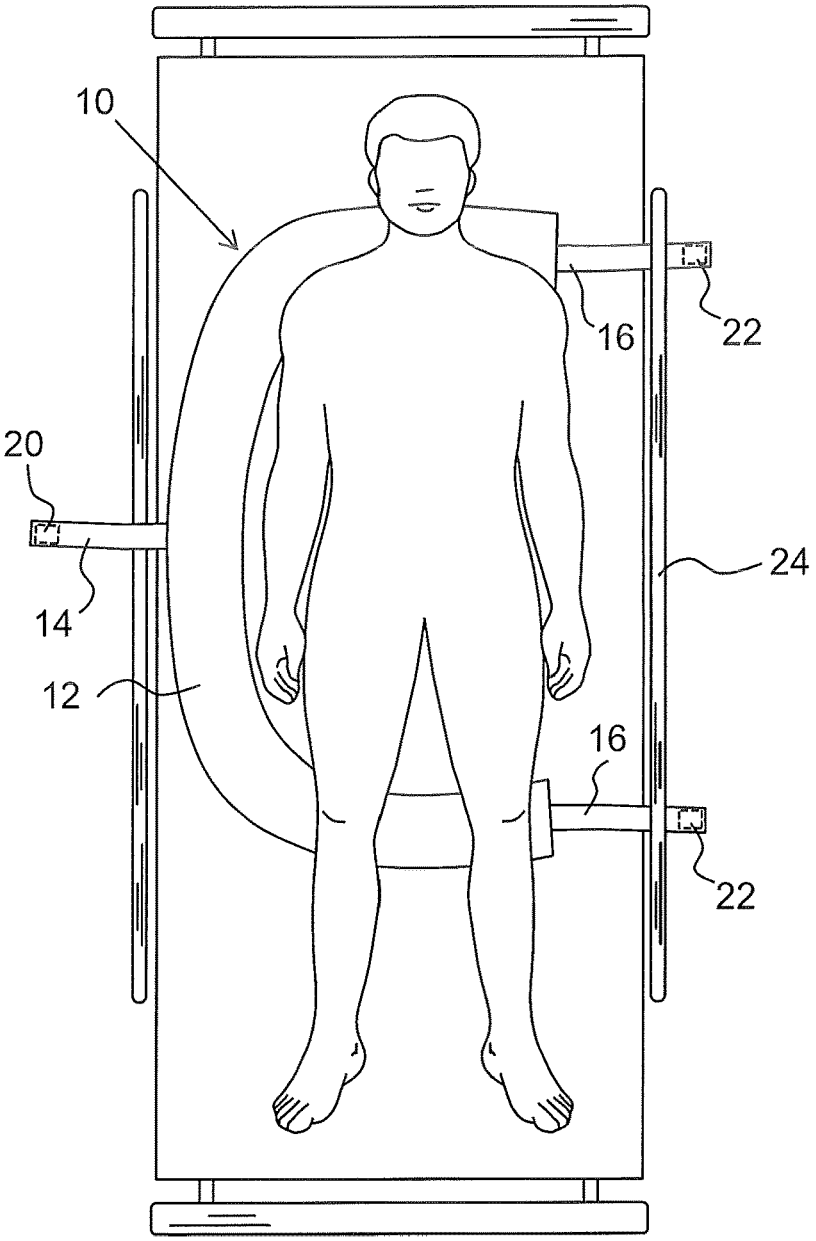
FIGS. 2A through 2C are diagrams illustrating use of the apparatus of FIG. 1 in turning a patient.
Figure 2B:
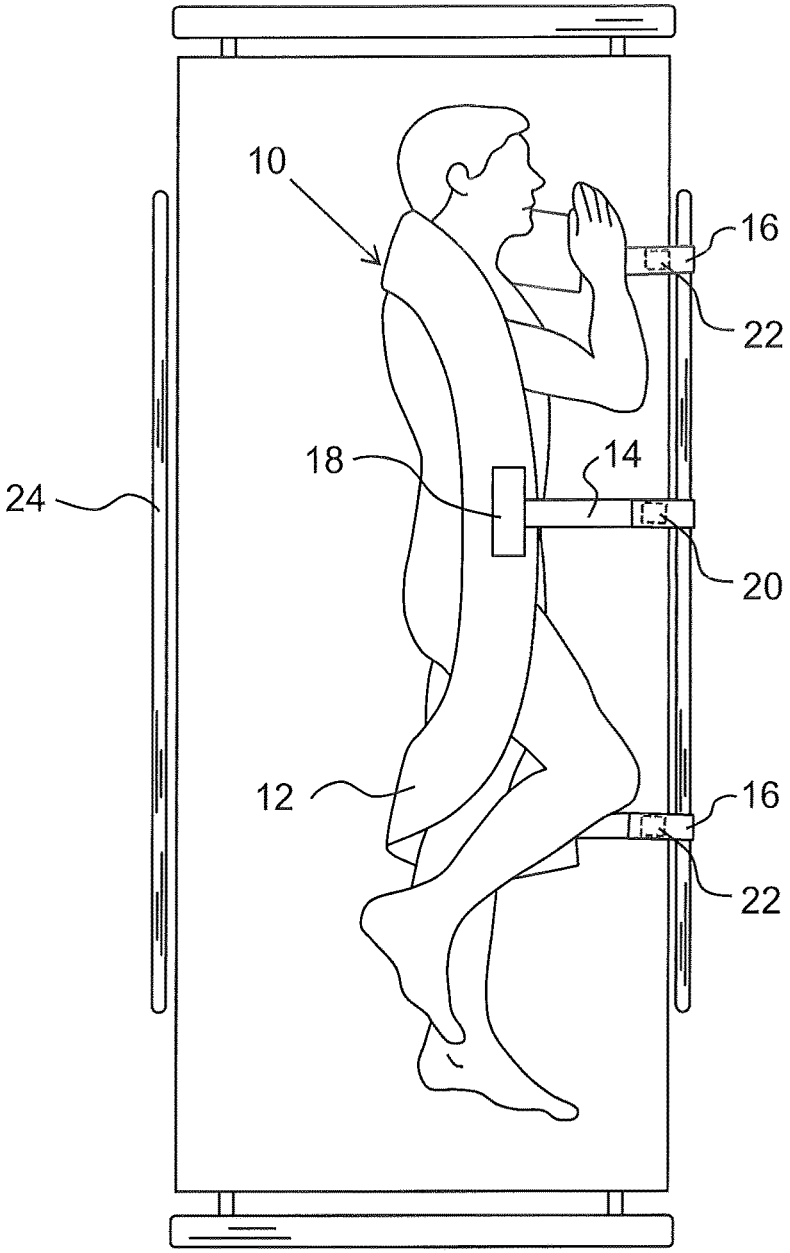
Figure 2C:
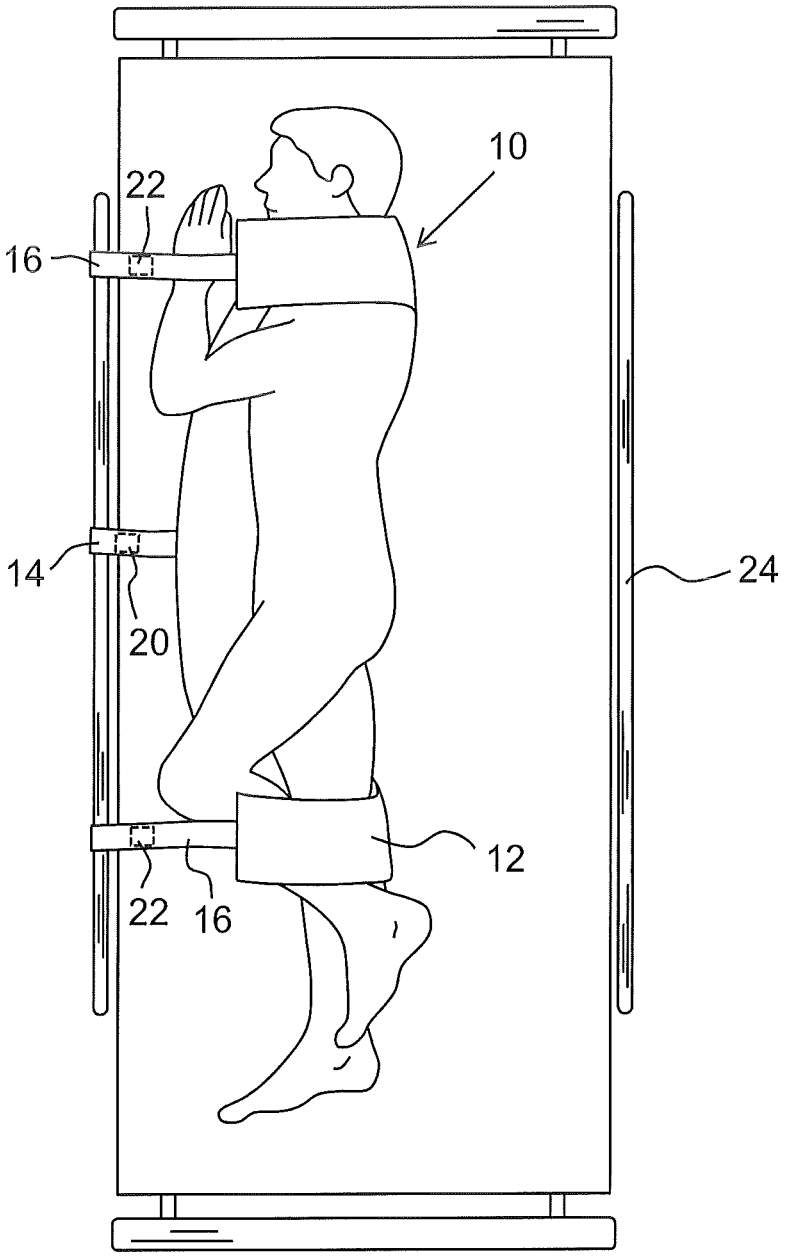

In this embodiment, the leverage or tension from the secured side straps facilitate the movement of the patient onto their side, thereby reducing the amount of force required by the caregiver to turn the patient. As shown in FIG. 2A, with the patient lying flat on his or her back in a stretcher or bed with the side rails up, the caregiver places one of the side straps under the patient's neck and the other side strap under the patient's knees. The two side straps are then attached to the bed or stretcher side rail. The caregiver then pulls the handle to turn the patient onto his or her side and the central strap is then attached to the side rail (FIG. 2B). The caregiver is then free to provide care to the patient. If needed, the caregiver can remove all straps from the rails and pull the two side straps toward the opposite bedrail, rolling the patient to the other side. The two side straps can then be attached to the opposite side rail (FIG. 3C) so that the caregiver can provide additional care to the patient. When completed, the caregiver will remove all of the straps from the side rails and gently return the patient to a lying position.

Figure 3A:
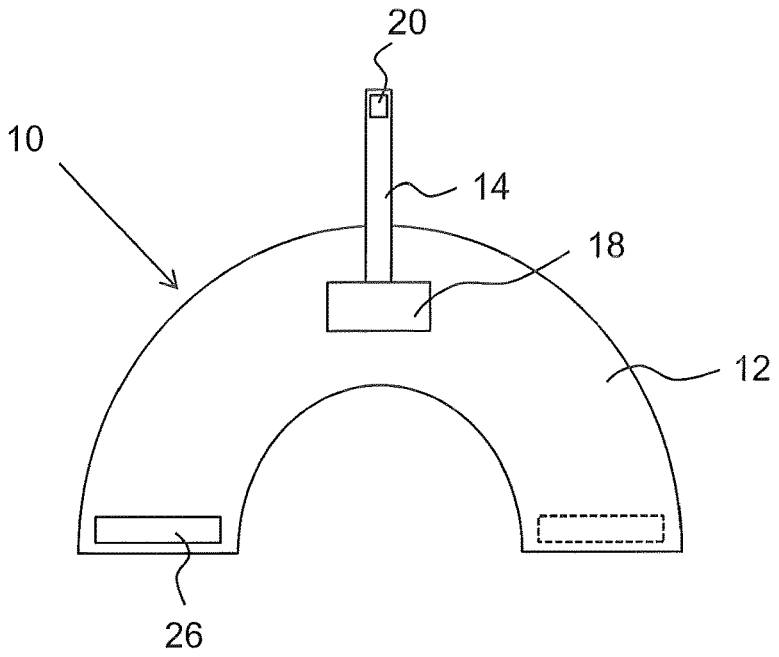
FIGS. 3A through 3C are diagrams illustrating an outside view (FIG. 3A), inside view (FIG. 4B) and joined view (FIG. 3C) of another nonlimiting embodiment of a U-shaped turning apparatus of this disclosure wherein the apparatus comprises a fastening means attached to the sling for joining the top of the sling to the bottom of the sling after placement under the patient's neck and knees.
Figure 3B:
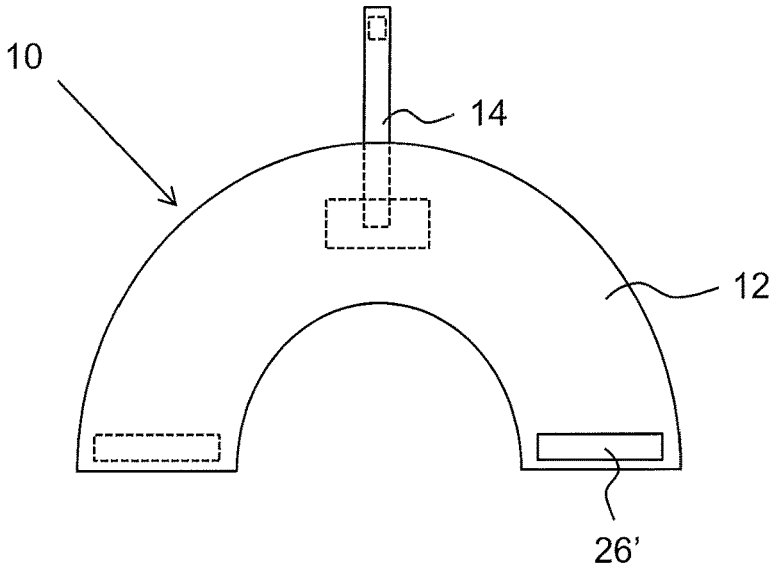
Figure 3C:
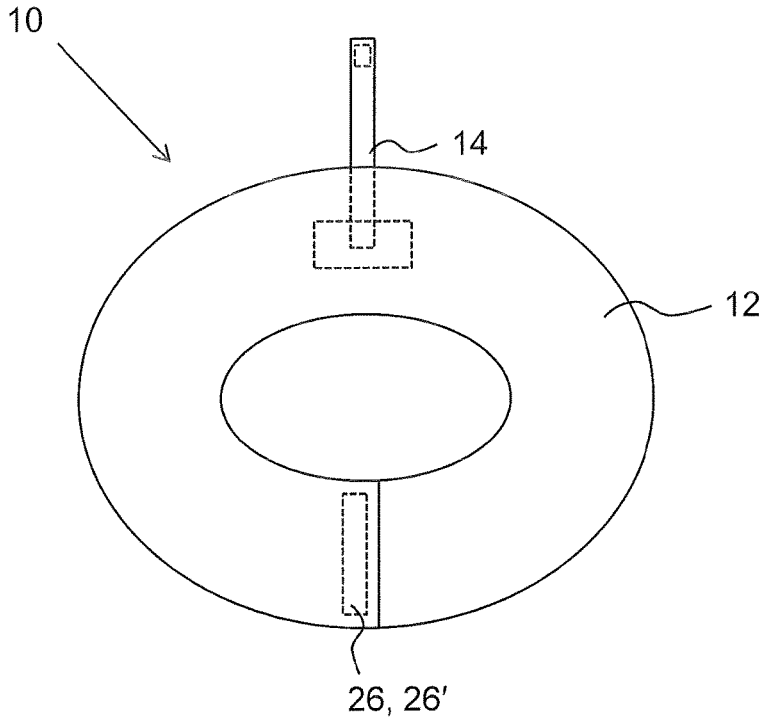
Figure 4A:
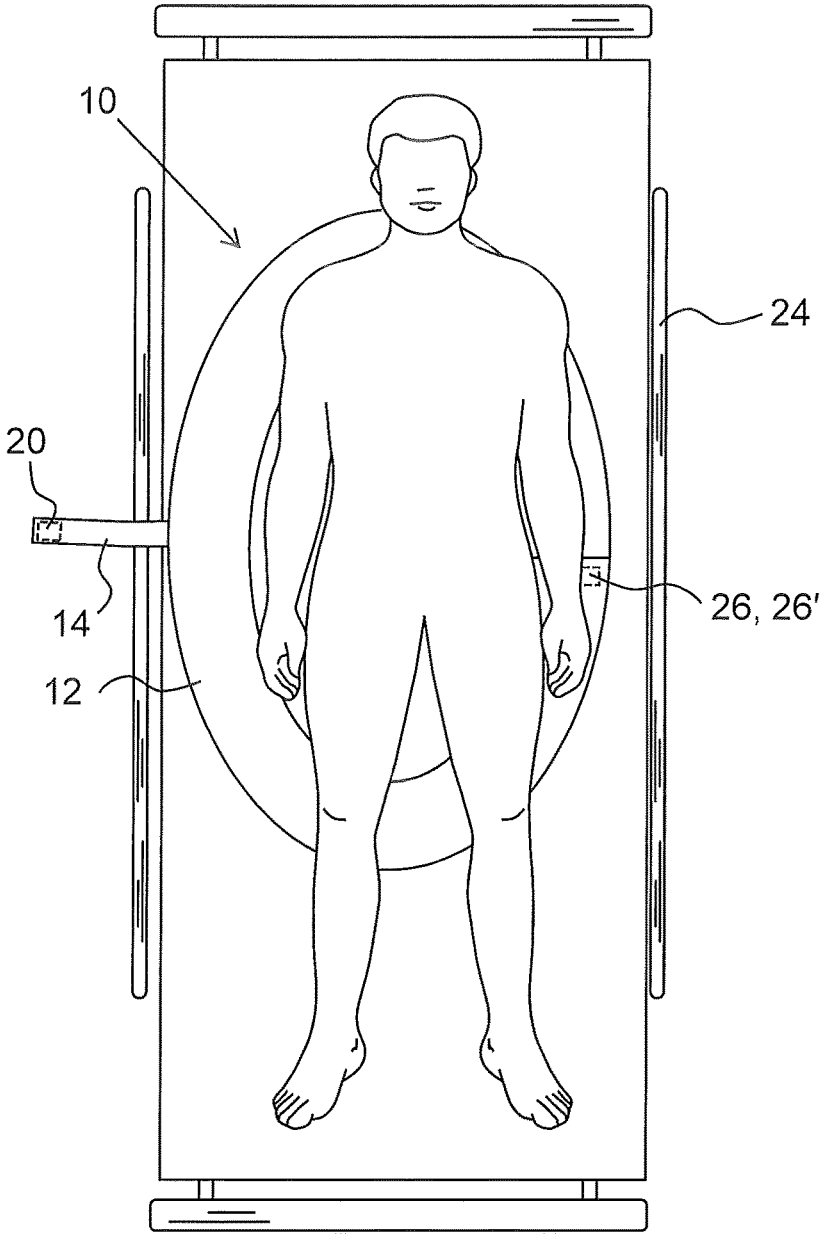
FIGS. 4A and 4B are diagrams illustrating use of the apparatus of FIG. 3 in turning a patient.
Figure 4B:
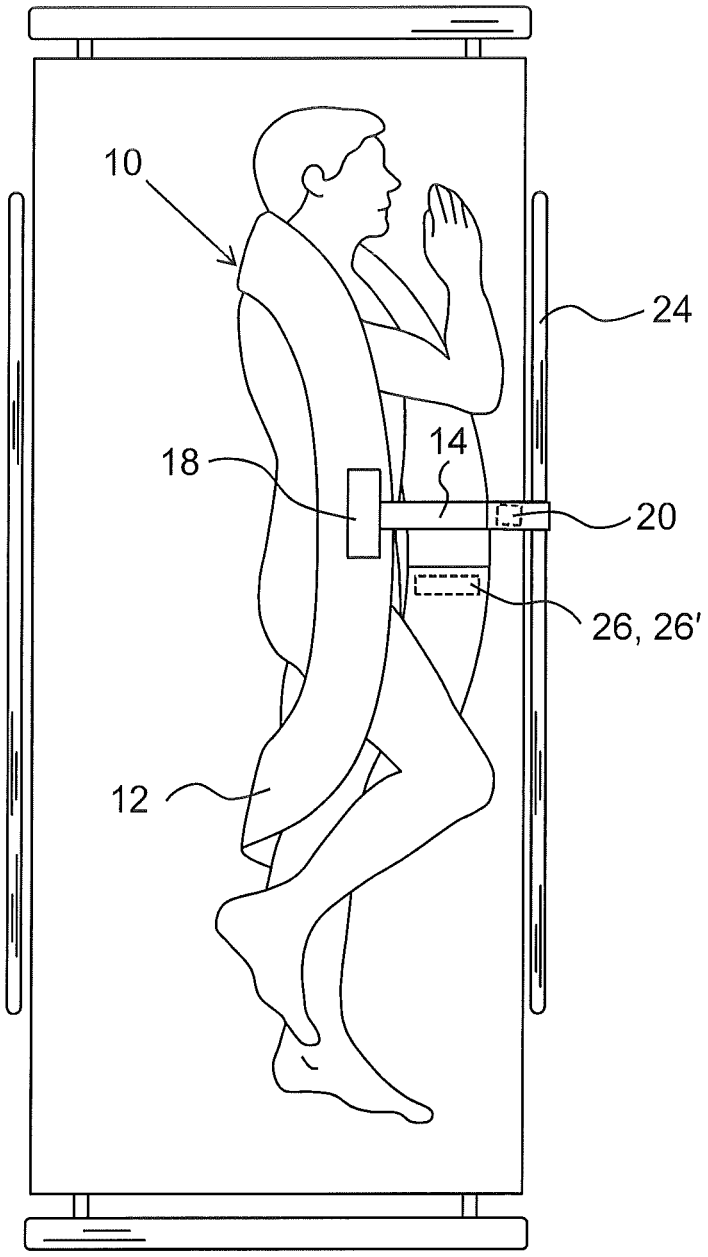

In another nonlimiting embodiment as depicted in FIGS. 3A through 4B, the sling 12 further comprises a fastening means 26, 26' for joining the top of the sling to the bottom of the sling after placement under the patient's neck and knees (See FIGS. 3C, 4A and 4B). Examples of fastening means useful in this embodiment include, but are not limited to, VELCRO, snaps, zippers, buttons, etc. In this embodiment, the patient's body weight secures the apparatus in place during turning and provides the leverage or tension to facilitate the movement of the patient onto their side without requiring undue force by the caregiver to turn the patient. In this nonlimiting embodiment, the apparatus further comprises one or more handles 18, 18' attached to the outside of the sling for pulling the sling and patient toward the secured apparatus, thereby turning the patient, and one or more central straps 14 with fastening means 20 for securing the straps to the stabilizing means, thereby keeping the patient in the turned position.

As shown in FIG. 4A, with the patient lying flat on his or her back in a stretcher or bed with the side rails up, the caregiver places the top portion of the sling under the patient's neck and the bottom portion of the sling under the patient's knees. The bottom and top portions of the sling are then joined to form a circle around the patient with the sling. The caregiver then pulls the handle or handles 18 to turn the patient onto his or her side and the central strap or straps 14 is then attached to the side rail (FIG. 4B). The caregiver is then free to provide care to the patient.

In one nonlimiting embodiment, the turning apparatus of this disclosure are used in conjunction with or attached to another patient transfer/assistive device or product such as, but not limited to, an absorption pad, a slider sheet or a bedpan in order to provide for or facilitate patient care activated including, but not limited to, elimination, transferring of a patient, incontinence care, surgical or procedural positioning and/or repositioning, bathing, wound care, assessment of skin, back, wound or rectal area, etc.

As will be understood by the skilled artisan upon reading this disclosure, alternative configurations to the sling, handles and/or side and central straps to those depicted in this patent application can be made and are encompassed by the present disclosure. Further, as will be understood by the skilled artisan upon reading this disclosure, use of this apparatus is not limited to caregivers of patients, but rather to any person or industry needing to reposition a heavy animate or even inanimate object fitting the sling. Examples include, but are in no way limited to, EMS, police, morgues, funeral homes, and veterinary facilities.

What is claimed is:

1. An apparatus for turning patients, said apparatus comprising:

a sling having an inside and outside and a top, bottom and center comprised of durable, flexible material shaped and sized to cradle a side of the patient's torso;

a first side strap with a first and second end attached at the first end to the top outside of the sling for placement under a patient's neck, the first side strap having a fastening means at the second end for securing the apparatus to a stabilizing means;

a second side strap with a first and second end attached by the first end to the outside bottom of the sling for placement under the patient's knees, the second side strap having a fastening means at the second end for securing the apparatus to the stabilizing means;

a central strap with a first and second end attached by the first end to the outside center of the sling, said central strap having a fastening means at the second end for securing the apparatus to the stabilizing means; and one or more handles on the outside of the sling for pulling the sling and patient toward a secured apparatus, thereby turning the patient wherein said apparatus does not require placement of anything under the patient's torso.

2. The apparatus of claim 1 wherein the sling is U-shaped.

3. The apparatus of claim 1 wherein the one or more handles is attached to the outside of the sling near the central strap.

4. The apparatus of claim 1 wherein the sling further comprises a fastening means for joining the top of the sling to the bottom of the sling after placement under a patient's neck and knees.

5. The apparatus of claim 1 further comprising a reinforcing area attached to the inside of the sling.

6. A method for turning patients which enables the caregiver to turn a patient lying in bed without having to place the turning apparatus under the patient's torso in order to turn the patient, said method comprising:

positioning the apparatus of claim 1 under the neck and knees of the patient;

securing the apparatus;

pulling the one or more handles of the apparatus toward the stabilizing means on or adjacent to the bed so that the patient turns onto their side toward the stabilizing means; and fastening one or more straps to the stabilizing means to hold the patient in place on their side.

7. An apparatus for turning patients, said apparatus comprising:

a sling having an inside and outside and a top, bottom and center comprised of durable, flexible material shaped and sized to cradle a side of the patient's torso;

a first side strap with a first and second end attached at the first end to the top outside of the sling for placement under a patient's neck, the first side strap having a fastening means at the second end for securing the apparatus to a stabilizing means;

a second side strap with a first and second end attached by the first end to the outside bottom of the sling for placement under the patient's knees, the second side strap having a fastening means at the second end for securing the apparatus to the stabilizing means;

two or more central straps, each strap having a first and second end, wherein the centrals straps are positioned and attached via the first end to the outside of the sling near the center to evenly distribute a patient's weight during turning, said central straps having a fastening means at the second end for securing the apparatus to the stabilizing means; and one or more handles on the outside of the sling for pulling the sling and patient toward a secured apparatus, thereby turning the patient wherein said apparatus does not require placement of anything under the patient's torso.

8. The apparatus of claim 7 wherein the two or more central straps are configured to each secure separately to the stabilizing means.

9. The apparatus of claim 7 wherein the two or more central straps are configured to gather together and secure as a single strap to the stabilizing means.

10. The apparatus of claim 7 wherein the sling further comprises a fastening means for joining the top of the sling to the bottom of the sling after placement under a patient's neck and knees.

11. The apparatus of claim 7 further comprising a reinforcing area attached to the inside of the sling.

12. The apparatus of claim 7 wherein the sling is U-shaped.

13. A method for turning patients which enables the caregiver to turn a patient lying in bed without having to place the turning apparatus under the patient's torso in order to turn the patient, said method comprising:

positioning the apparatus of claim 7 under the neck and knees of the patient;

securing the apparatus;

pulling the one or more handles of the apparatus toward the stabilizing means on or adjacent to the bed so that the patient turns onto their side toward the stabilizing means; and fastening one or more straps to the stabilizing means to hold the patient in place on their side.

* * * * *